US005575428A

United States Patent [19]

Cordonnier et al.

[11] Patent Number: 5,575,428

[45] Date of Patent: Nov. 19, 1996

[54] CONE VIBRATING MILL AND PROCESS FOR ADJUSTING THE OPERATION OF SUCH A MILL

[75] Inventors: Alain Cordonnier, Lille; Renaud Evrard, Lecelles, both of France

[73] Assignee: FCB, Montreuil, France

[21] Appl. No.: 343,568

[22] PCT Filed: Mar. 22, 1994

[86] PCT No.: PCT/FR94/00309

§ 371 Date: Jan. 26, 1995

§ 102(e) Date: Jan. 26, 1995

[87] PCT Pub. No.: WO94/21380

PCT Pub. Date: Sep. 29, 1994

[30] Foreign Application Priority Data

Mar. 24, 1993 [FR] France ..... 93 03375

[51] Int. Cl.[6] ..... B02C 2/00; B02C 25/00

[52] U.S. Cl. ..... 241/30; 241/37; 241/207; 241/36

[58] Field of Search ..... 241/207–216, 241/30, 36, 37

[56] References Cited

U.S. PATENT DOCUMENTS 3,944,146 3/1976 Stockmann et al. ..... 241/30
4,272,030 6/1981 Afansiev et al. .
4,964,580 10/1990 Akesaka .

FOREIGN PATENT DOCUMENTS 2687080 8/1993 France .
886969 6/1981 U.S.S.R. .
837396 12/1981 U.S.S.R. .
1416181 8/1988 U.S.S.R. .
2211004 6/1989 United Kingdom ..... 241/36

*Primary Examiner*—Mark Rosenbaum
*Attorney, Agent, or Firm*—Collard & Roe, P.C.

[57] ABSTRACT

A grinding mill comprises a support structure, a frame movable with respect to the support structure, a bottomless bowl supported on the frame, vibrators for imparting circular and approximately horizontal vibrations to the bowl, and a cone fitted inside the bowl and mounted on the support structure for free rotation around an axis of the cone. The speed of rotation of the cone around the axis is measured, the bowl and the cone defining a gap therebetween for receiving a layer of a material to be ground upon rotation of the cone, and for the ground material to be discharged in a discharge plane. A minimum thickness of the layer of ground material in the discharge plane is determined on the basis of a measured value of the cone rotation, and the frequency and/or amplitude of the bowl vibrations is adjusted so as to maintain the minimum thickness of the layer at a set value.

6 Claims, 2 Drawing Sheets

CONE VIBRATING MILL AND PROCESS FOR ADJUSTING THE OPERATION OF SUCH A MILL

Figure 1:
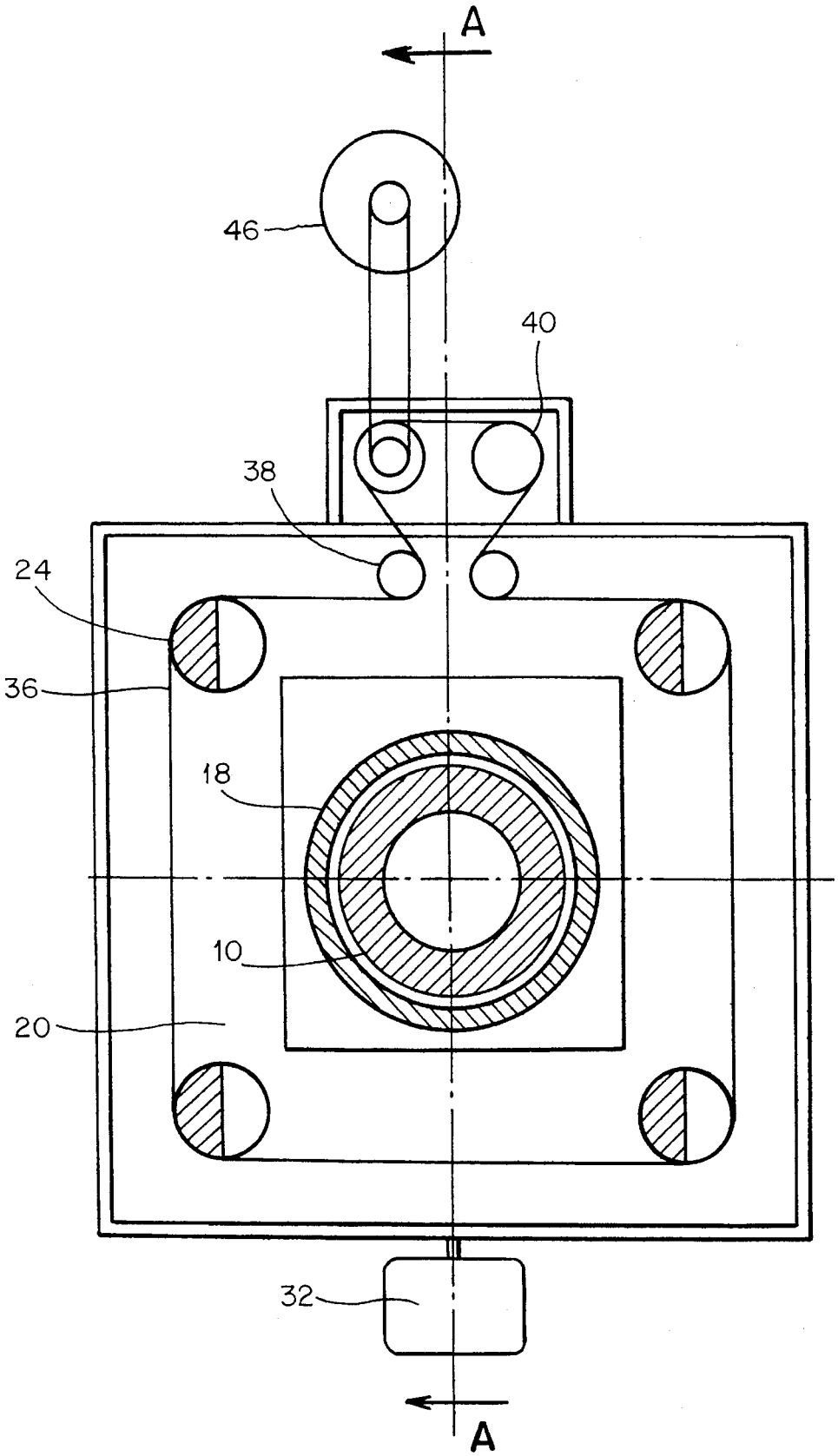

This invention relates to grinding mills in which the material is ground between a cone and a bottomless truncated cone shaped bowl which surrounds the cone, the working surfaces of both the cone and the bowl being provided with an antiwear lining, and in which the bowl is mounted on a frame movable with respect to the supporting structure and equipped with means capable of imparting circular and approximately horizontal vibrations or oscillations to the bowl which makes the bowl move closer to and away from the cone, successively in all radial planes. The means used to make the bowl vibrate or oscillate can be unbalanced vibrators, electromagnetic vibrators, etc.

The principle of these machines has been known for a long time but, in practice, the machines have been scarcely used. In known machines of this type, the cone is rigidly fastened to its support, and, because of the circular movements of the bowl, the movements of the bowl away from and closer to the cone which result in crushing the material to be ground are accompanied by relative displacements parallel to the tangent planes which make the machine unstable and cause a rapid wearing out of the cone and bowl working surfaces. Moreover, the presently known machines do not lend themselves to an automated control enabling to obtain a given particle size.

The purpose of this invention is to make it possible to monitor the operation of the mill and to keep a closer eye on its condition, while extending the service life of the working surfaces.

The grinding mill forming the subject of this invention is characterized in that the cone is so mounted on its support as to be able to rotate freely around its axis and is equipped with means for measuring its speed of rotation around, which means are functionally connected with a system which adjusts the parameters—frequency and amplitude—of the bowl vibration generating means and with a system which adjusts the height of the cone with respect to the bowl.

The speed of rotation of the cone being known, one can determine, for a given setting of the mill (width of the annular gap in the ground material discharge plane), the thickness of the layer of material in the ground material discharge plane and, if necessary, modify it by adjusting the frequency and/or amplitude of the bowl vibration generating means and/or the height of the cone, so as to obtain a ground product with the required particle size; these means permit to control automatically the operation of the mill. Moreover, for given settings of the frequency and amplitude of the bowl vibration generating means and of the discharge-gap width, the evolution of the cone rotation speed permits to assess the wear of the cone and bowl working surfaces.

Another subject of this invention is a process for adjusting a mill of the above-defined type consisting in measuring the speed of rotation of the cone around its axis, in determining the minimum thickness of the layer of material in the ground material discharge plane from the cone rotation speed measurement and the measured width of the annular gap existing in the said plane between the cone and the bowl when the mill is at a standstill, and in setting the parameters of the bowl vibration generating means and/or the height of the cone with respect to the bowl to keep the minimum thickness of the layer of material equal to a set value.

Figure 2:
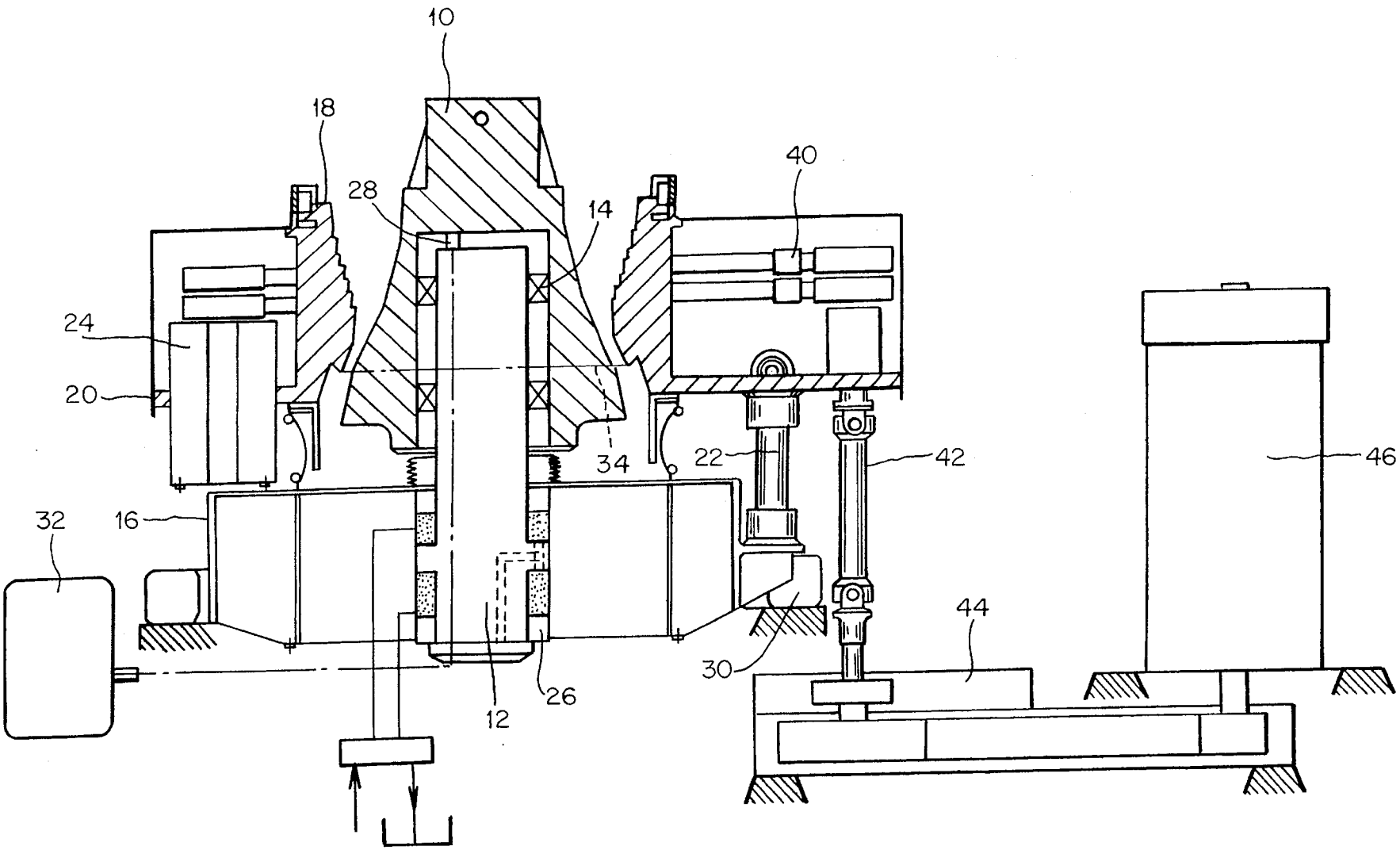

The following description refers to the accompanying drawing which shows, as a non-limiting example, an embodiment of the invention. On this drawing:

FIG. 1 is a top view of a vibrating cone mill constructed according to the invention ;and FIG. 2 is a vertical section view, according to A—A, of the mill shown in FIG. 1;

In the mill of FIGS. 1 and 2, cone 10 is mounted, by means of bearings 14, on a shaft end 12 which is supported by a structure 16; this mounting allows the cone to rotate freely around its axis. Structure 16 rests on an elastic system 30 which reduces the transmission of the efforts and vibrations to the ground. With a view to reducing the amplitude of frame vibrations, the frame could be equipped with vibration generating means submitting it to efforts in antiphase to those due to bowl 18 during the grinding. Structure 16 could rest directly on a correctly sized foundation block.

Bowl 18 is secured to a frame 20 supported by a series of connecting rods 22 the ends of which are articulated with the frame and the structure.

Unbalanced vibrators 24 are mounted on frame 20. They are synchronously driven so as to generate low-amplitude horizontal circular motions of the frame-bowl assembly. Driving is ensured through a mechanism consisting of belts 36, tension rollers 38, driving pulleys 40, Cardan joints 42, a motor 46 and a dephasing device of the type described in French patent No. 92 01642 (publication No. 2 687 080) and permitting to adjust the amplitude of vibrations. Motor 46 is equipped with a speed variator permitting to adjust the vibration frequency.

The vibrating motions of the frame-bowl assembly make the bowl periodically move closer to the cone in every radial plane and, consequently, cause the material to be crushed between the bowl and the cone. A layer of material the thickness of which depends on the flow rate and frequency and amplitude of the vibrations builds up on the inside surface of the bowl. This layer moves down to the bottom of the bowl and the ground products are removed through the discharge gap and fall into a receiving bin located under the mill along an annular passage provided in the structure.

The motions of the bowl are accompanied with a rotation of cone 10 around its axis generated by the tangential efforts exerted by the bowl, through the material to be ground. This rotation permits to obtain a stable comminution process and to significantly reduce the wearing out of the cone and bowl linings.

The mill is equipped with a system 26 for adjusting the height of the cone with respect to bowl 18, for example a screw and nut system or a hydraulic cylinder. This system permits to adjust the width of the annular gap between the cone and the bowl in the ground material discharge plane 34; when the mill is at a standstill, the width of this gap is constant all along its circumference and equal to the difference between the cone and bowl radii in discharge plane 34.

During grinding, a layer of material the minimum thickness of which, defined by the minimum distance between the cone and the bowl in the discharge plane, depends on the initial height setting of the cone with respect to the bowl and on the amplitude and frequency of the vibrations, builds up between the cone and the bowl. The ground product particle size depends on the minimum thickness of the layer of materials; therefore, it is possible to monitor the ground product quality by adjusting the amplitude or the frequency of the vibrators, and to some extent the height setting of the cone, by means of system 26.

A cone rotation-speed metering device 28, such as a magnetic induction sensor (Make IFM-type IFK3004 BPOG, for example), permits to know this value at any moment and, the setting value of the annular discharge gap width being known, to work out the thickness of the layer of materials.

The cone rotation speed is given by the following formula:

$$N = K \frac{n \cdot (f - e)}{D \cdot \cos\alpha}$$

where:

K=constant n=vibration frequency (rotation speed of vibrators)

f=setting value of annular discharge gap e=layer thickness

α=½ cone top angle

This formula permits to calculate e, to compare the obtained value with a set value and, if required, to adjust the amplitude and/or the frequency of the vibrations or the width, f, of the gap.

Therefore, the control of the mill can be automated, in order to obtain ground products with the required particle size, by means of a programmable logic controller or a computer 32 which receives the data from sensor 28 and which can send instructions to the dephasing device 44 and to motor 46 so as to adjust the amplitude and/or the frequency of the vibrations, and to system 26 in order to modify the height setting of the cone.

As explained above, it is also possible, by observing the variations of the cone rotation speed in given operating conditions, to detect the wearing out of the cone and bowl working surfaces.

It must be understood that any modifications which may be made to the described embodiments, by using equivalent technical means, and relating, in particular, to the rotating mounting of the cone on the structure and to the bowl vibration generating means fall within the scope of this invention.

We claim:

1. A grinding mill comprising (a) a support structure, (b) a frame movable with respect to the support structure, (c) a bottomless bowl supported on the frame, (d) means for imparting circular and approximately horizontal vibrations to the bowl, (e) a cone fitted inside the bowl and mounted on the support structure for free rotation around an axis of the cone, (f) means for measuring the speed of rotation of the cone around the axis, (1) the bowl and the cone defining a gap therebetween for receiving a layer of a material to be ground upon rotation of the cone, and for the ground material to be discharged in a discharge plane, (g) means for determining a minimum thickness of the layer of ground material in the discharge plane on the basis of a measured value of the speed of rotation of the cone, and (h) means for adjusting the frequency and/or amplitude of the bowl vibrations so as to maintain the minimum thickness of the layer at a set value.

2. The grinding mill of claim 1, wherein the means for imparting circular and approximately horizontal vibrations to the bowl comprises vibrators mounted on the frame.

3. The grinding mill of claim 1, further comprising a system for adjusting the height setting of the cone with respect to the bowl.

4. A process for adjusting a grinding mill comprising a support structure, a frame movable with respect to the support structure, a bottomless bowl supported on the frame, means for imparting circular and approximately horizontal vibrations to the bowl, and a cone fitted inside the bowl and mounted on the support structure for free rotation around an axis of the cone, the bowl and the cone defining a gap therebetween for receiving a layer of a material to be ground upon rotation of the cone, and for the ground material to be discharged in a discharge plane, which process comprises the steps of (a) measuring the speed of rotation of the cone around the axis, (b) determining a minimum thickness of the layer of ground material in the discharge plane on the basis of a measured value of the speed of rotation of the cone and a width of the gap in the discharge plane when the mill is at a standstill, and (c) adjusting the frequency and/or amplitude of the bowl vibrations so as to maintain the minimum thickness of the layer at a set value.

5. The adjusting process of claim 4, comprising the further step of adjusting the height setting of the cone with respect to the bowl so as to maintain the minimum thickness of the layer at a set value.

6. The adjusting process of claim 4, comprising the further steps of determining the wear of the bowl and cone surfaces defining the gap on the basis of variations in the speed of the cone rotation for given settings of the frequency and amplitude of the bowl vibrations and of the width of the gap in the discharge plane.

* * * * *